US008837761B2

(12) United States Patent
Jinton

(10) Patent No.: US 8,837,761 B2
(45) Date of Patent: Sep. 16, 2014

(54) VIBRATOR WITH ADJUSTMENT SYSTEM

(75) Inventor: Lars Jinton, Smørum (DK)

(73) Assignee: Oticon Medical A/S, Smorum (DK)

( * ) Notice: Subject to any disclaimer, the term of this patent is extended or adjusted under 35 U.S.C. 154(b) by 430 days.

(21) Appl. No.: 13/171,197

(22) Filed: Jun. 28, 2011

(65) Prior Publication Data

US 2011/0317859 A1 Dec. 29, 2011

Related U.S. Application Data

(60) Provisional application No. 61/359,375, filed on Jun. 29, 2010.

(30) Foreign Application Priority Data

Jun. 29, 2010 (EP) ..... 10167651

(51) Int. Cl.
*H04R 25/00* (2006.01)

(52) U.S. Cl.
CPC ..... *H04R 25/606* (2013.01); *H04R 2460/13* (2013.01); *H04R 2225/67* (2013.01)
USPC ..... 381/326; 381/380

(58) Field of Classification Search
USPC ..... 381/326, 327, 380
See application file for complete search history.

(56) References Cited

U.S. PATENT DOCUMENTS

| | | | | |
|---|---|---|---|---|
| 1,356,156 | A | 10/1920 | Kurman | |
| 2,143,130 | A | 8/1938 | Greibach | |
| 2,500,541 | A | 3/1950 | Greibach | |
| 2,680,157 | A | 6/1954 | Wolff | |
| 5,460,593 | A * | 10/1995 | Mersky et al. | 600/25 |
| 6,668,065 | B2 * | 12/2003 | Lee et al. | 381/380 |
| 8,363,870 | B2 * | 1/2013 | Åsnes | 381/326 |
| 2003/0012395 | A1 * | 1/2003 | Fukuda | 381/380 |
| 2007/0291972 | A1 * | 12/2007 | Abolfathi et al. | 381/326 |
| 2008/0273731 | A1 * | 11/2008 | Giannetti | 381/327 |

FOREIGN PATENT DOCUMENTS

| | | |
|---|---|---|
| GB | 444175 | 3/1936 |

* cited by examiner

*Primary Examiner* — Duc Nguyen
*Assistant Examiner* — Phan Le
(74) *Attorney, Agent, or Firm* — Birch, Stewart, Kolasch & Birch, LLP

(57) ABSTRACT

A vibrator is provided with a spring having a first end and a second end and, a frame immovably attached to the second end where the frame is carrying a movable armature and at the second end of the spring a coupling with an armature plate is immovably attached. The armature plate and the movable armature are provided in close proximity with an air gap there between and a permanent magnet is associated with one or both of the armature plate and/or the movable armature and an electrical coil is associated with one or both of the armature plate and/or the movable armature. An adjustment screw is provided to displace the movable armature towards or away from the armature plate, wherein the screw is inserted in a bore. In an aspect of the invention, the bore has a length axis placed along a plane of intersection between the movable armature and the frame and one part of the bore is provided in the movable armature and an opposed part of the bore is provided in the frame, whereby one part of the bore is threaded and the opposed part is unthreaded.

11 Claims, 11 Drawing Sheets

VIBRATOR WITH ADJUSTMENT SYSTEM

CROSS REFERENCE TO RELATED APPLICATIONS

This non-provisional application claims the benefit under 35 U.S.C. 119(e) of U.S. Provisional Application No. 61/359,375 filed on Jun. 29, 2010 and claims priority under 35 U.S.C. 119 (a) to Patent Application No. 10167651.8 filed in European Patent Office, on Jun. 29, 2010. The entire contents of all of the above applications are hereby incorporated by reference.

TECHNICAL FIELD

In bone conduction vibrators a very small air gap is provided between a first and a second armature part, where these parts are attached to each their end of a spring. By energizing at least one of the armatures through an electromagnetic element, the two parts may be caused to vibrate towards and away from each other with maximum amplitude defined by the air gap. The size of the air gap is paramount to the energy efficiency of the vibrator and should be kept as small as possible, while at the same time, large amplitude is wished. For this reason a very precise adjustment of the air gap is very important.

BACKGROUND ART

From U.S. Pat. No. 2,143,130 a bone conduction hearing aid device is known, wherein a set screw with a shoulder portion engaging the opposite surface of a core cross piece is provided, so that by turning the set screw a pole piece core is deformed and withdrawn from its contact with the armature and retained in a fixed position in which a small effective magnetic gap of a fraction of a thousandth of an inch is maintained between the pole faces of the pole pieces and the armature during operation of the receiver.

Constructions effecting similar adjustment of the air gap are found in prior art documents GB444175; U.S. Pat. No. 2,127,468; U.S. Pat. No. 1,356,156 and U.S. Pat. No. 2,680,157.

In a further prior art example, the air gap is adjusted through grinding of a distance element as is explained in the following.

DISCLOSURE OF INVENTION

A vibrator is provided with a spring having a first end and a second end and, a frame immovably attached to the second end where the frame is carrying a movable armature and at the second end of the spring a coupling with an armature plate is immovably attached. The armature plate and the movable armature are provided in close proximity with an air gap there between and a permanent magnet is associated with one or both of the armature plate and/or the movable armature and an electrical coil is associated with one or both of the armature plate and/or the movable armature. An adjustment screw is provided to displace the movable armature towards or away from the armature plate, wherein the screw is inserted in a bore. In an aspect of the invention, the bore has a length axis placed along a plane of intersection between the movable armature and the frame and one part of the bore is provided in the movable armature and an opposed part of the bore is provided in the frame, whereby one part of the bore is threaded and the opposed part is unthreaded.

With this vibrator, the air gap is adjustable by turning of the screw placed in the bore. By axially arresting the movement of the screw with respect to the one part and turning the screw, the interaction between the threads on the screw shaft and the thread in the other part, will move this other part up or down in correspondence with the direction of rotation of the screw. When the screw is rotated in this position, the surface part of the bore with no threads will function as a bearing wherein the threaded screw shaft rotates without axial movement of the screw with respect to this surface part.

The threaded part of the bore may be provided in the movable armature and an arrest surface may be provided in the frame adjacent the bore and may be adapted to interact with a part of the screw and arresting motion of the screw in at least one axial direction. In this way the screw will be lifting the movable armature away from the armature plate when continued rotation of the screw is performed.

The screw may at a first end thereof comprise a tool engaging portion for turning the screw. Such a tool engaging portion is well known in the art and may comprise internal or external hexagons or a simple slot. A well known standard tool can be made to interact with the screw when such a tool engaging part is provided.

A radially extending flange may be provided at the tool engaging portion adapted to abut the arrest surface at the frame. In the event that the screw comprises a head portion, the underside of such a head portion may well work to abut the arrest surface and block further downbore motion of the screw, despite continued rotation thereof.

A radially extending surface may be provided at a screw part disposed at the opposite end relative to the tool engaging portion and adapted to abut an arrest surface of the frame. Such a radially extending surface may simply be the end part of the screw shaft being ground more or less even. This end portion may thus abut an end portion of the bore part in the frame.

Tree screws may be provided and spaced evenly around the circumference of the electrical coil. This allows the movable armature to be lifted without tilt with respect to the axis of the armature plate.

BRIEF DESCRIPTION OF THE DRAWINGS

With reference to FIGS. 1 and 2 the elements of the vibrator are described in detail. The central part of the vibrator 1 is the spring 2, which at a first end 12 thereof is fastened to a coupling 3 and an armature plate 4. The coupling 3 is shaped to couple immovable to a body, which is to receive vibrations. In the present case this body is the skull bone (not shown) of a hearing aid user, and the coupling will be fastened to a screw (not shown) which is implanted in the skull bone of the user. Alternatively the coupling is pressed towards a user's skin at the skull by use of a headband or similar device to provide a sufficient contact pressure in order to transfer vibrations through the skin and into the skull bone. At the opposed end 13 of the spring 2, a frame 100 is immovably fastened. The frame 100 carries a magnetic armature 110, 120 which is positioned in close proximity of the armature plate 4. The magnetic armature 110, 120 will be magnetically attracted to or repulsed from the armature plate 4, and the magnetic force is balanced by the spring 2 to keep a distance between the two. In the embodiment shown the spring 2 is a flat, blade spring, wherein the first part 12 of the spring is the centre thereof and wherein the second part 13 is the outer peripheral edge thereof.

As seen in FIGS. 1 and 2 the frame 100 is connected to the spring 2 through a distance element 101. The spring is provided in a generally square shape with a screw opening 14 in each corner and through each opening 14 a screw 15 passes and fastens into the frame 100 through holes 102 in the distance element 101. The four corners of the spring 2 are in this manner fastened immovably to the frame 100. Similarly the centre part of the spring 2 defined by the opening 12 is immovably fastened to the coupling armature 4 by screwfastening the armature plate 4 to the coupling 3 from each their side of the opening 12.

Figure 1:
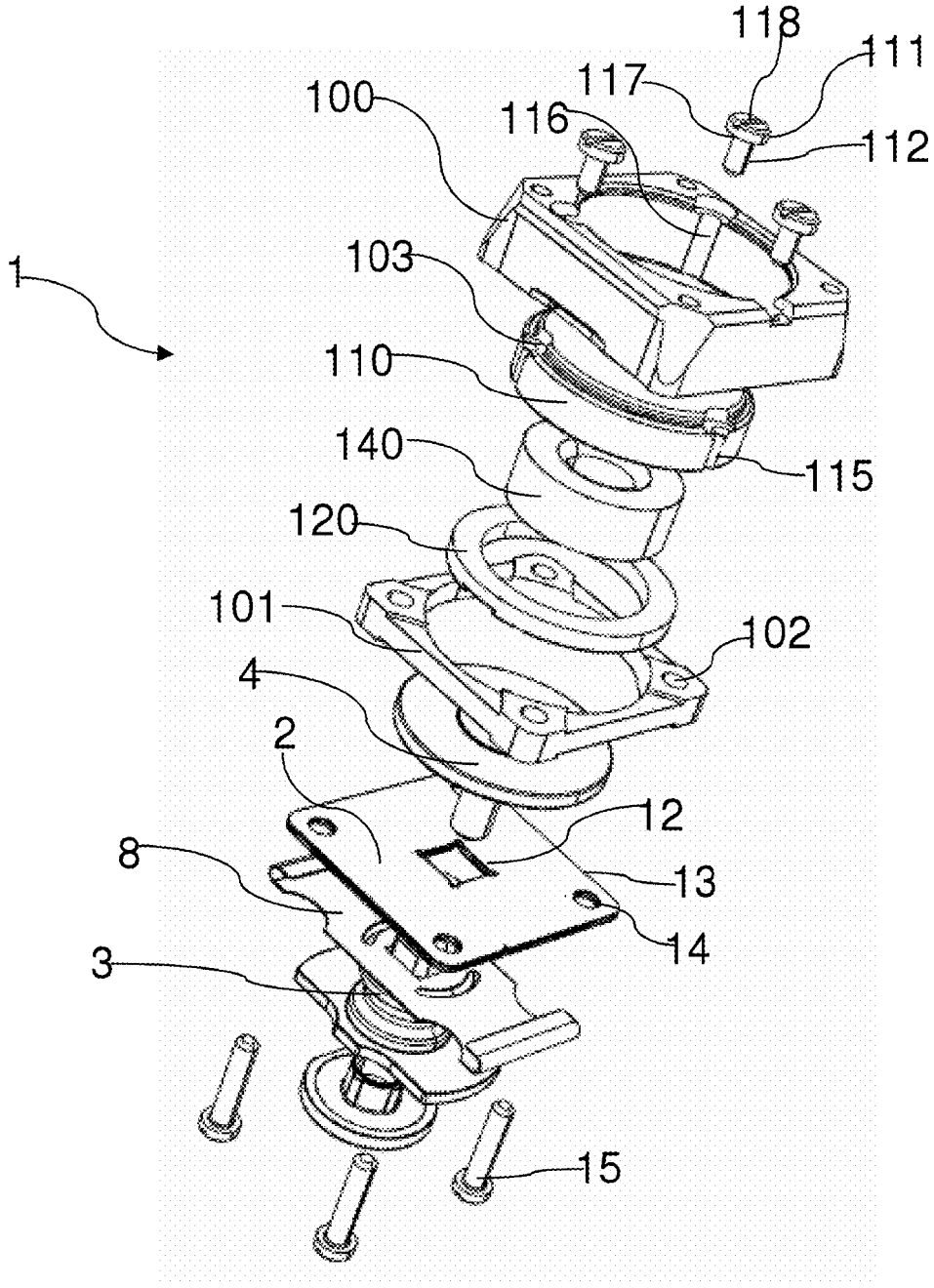
FIG. 1 shows an exploded view of a first embodiment of the invention.

In order for the proper functioning of the vibrator, the armature plate 4 and the magnetic armature 110 are to be placed with a well defined distance between surfaces thereof, this distance being very small. This distance is termed "the air gap" throughout the application.

In a prior art method of adjusting the air gap, the thickness of the distance element is reduced in consecutive steps, until the right size of the air gap is reached. This process is slow and there is a risk that in the last step too much material is removed and the air gap becomes too small.

According to the present invention the magnetic armature 110 is suspended to be movable relative to the frame 100. The suspension comprise screws 111 with threaded shafts 112 each placed in bores provided in the intersection between the frame 100 and the magnetic armature 110. For stability reasons three screws 111 are provided evenly spaced around the periphery of the magnetic armature 110. The bores each comprise a threaded part 115 thereof provided in the magnetic armature 110 and a not threaded part 116 provided in the frame 100. The threaded shaft 112 will slide in the not threaded part 116 in the frame 100 whereas the threads of shaft 112 will fit the threads of the threaded part 115 of the bore. The screws 111 also comprise heads, with a radially extending flange 117 provided at an underside thereof. This flange 117 is provided to abut an arrest surface of the frame 100 such that the screw shaft 112 is barred from further downward movement. When the screw is turned in abutment with the frame 100, it will carry and lift the magnetic armature when each screw is turned in the bore with the threads of the screw shaft 112 in operative engagement with the threads of the threaded part 115. A recess 103 in the magnetic armature 110 is provided with a depth sufficient to not interfere with the flange 117 when the armature 110 is lifted by the turning of screw 111 with abutment between the flange 117 and the arrest surface. If need be, a small pressure shall be supplied to the screw head, in order to assure abutment with the frame when the armature is lifted or lowered.

When the screw 111 is turned beyond the abutment point between the flange 117 and the adjacent surface of the frame 100, the armature 110 will be lifted away from the armature plate 4 and the air gap 130 between these two parts will be increased. If the screw 111 is turned in the opposite direction the air gap is decreased. In this way the air gap 130 may be easily adjusted by turning each of the three screws 111 the same angle past the point of abutment as described above. Each screw 111 has a slot 118 in the head thereof to accomplish this turning. Once the right size of the air gap (indicated by arrow 130) is reached, the frame and armature may be permanently joined by any ordinary way, such as by use of glue or cement, soldering, welding as by laser, arresting screws or the like as well known in the art.

In an (not shown) embodiment the screw will abut at its lower end onto a flange part provided at the bottom of the half bore in the frame 100. If this is provided, the screw can be made without a radially extending flange 117, as the lower end of the screw will abut a flange, when the desired depth is reached, and it is desired, that further turning of the screw is to lift or lower the magnetic armature. A slot must still be provided, such as hexagon or other slot at the top of the screw.

Figure 2:
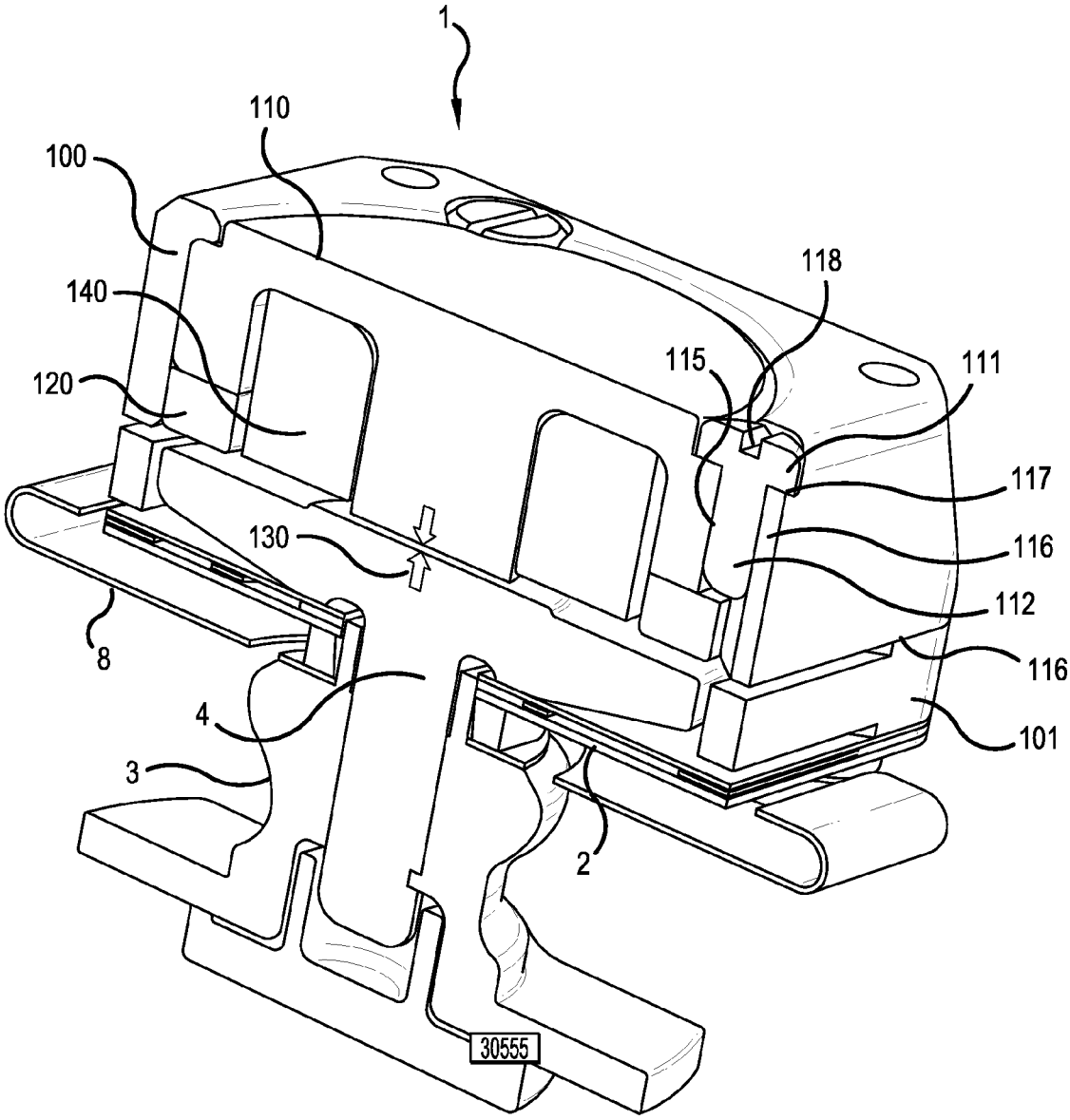
FIGS. 2 and 2*a* shows a section in a 3D projection of the vibrator disclosed in FIG. 1.

As seen in FIGS. 1 and 2, the frame 100 is open at a top part thereof, allowing access to the armature 110, and also allowing easy application of glue or the like when the right size of the air gap 130 is reached.

Figure 7:
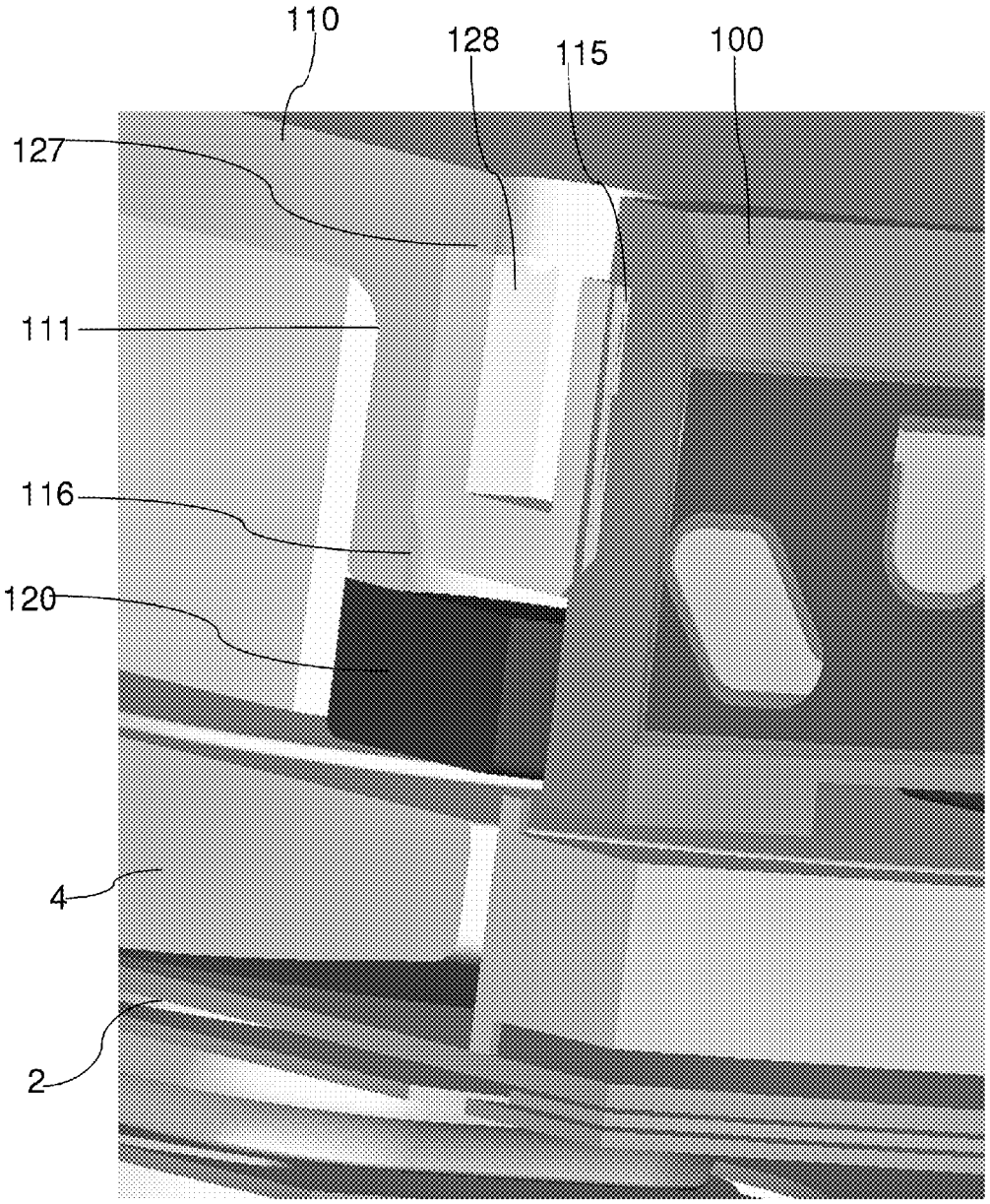
FIGS. 7 and 7*a* illustrate a screw and bore arrangement according to an embodiment of the present invention.
Figure 7A:
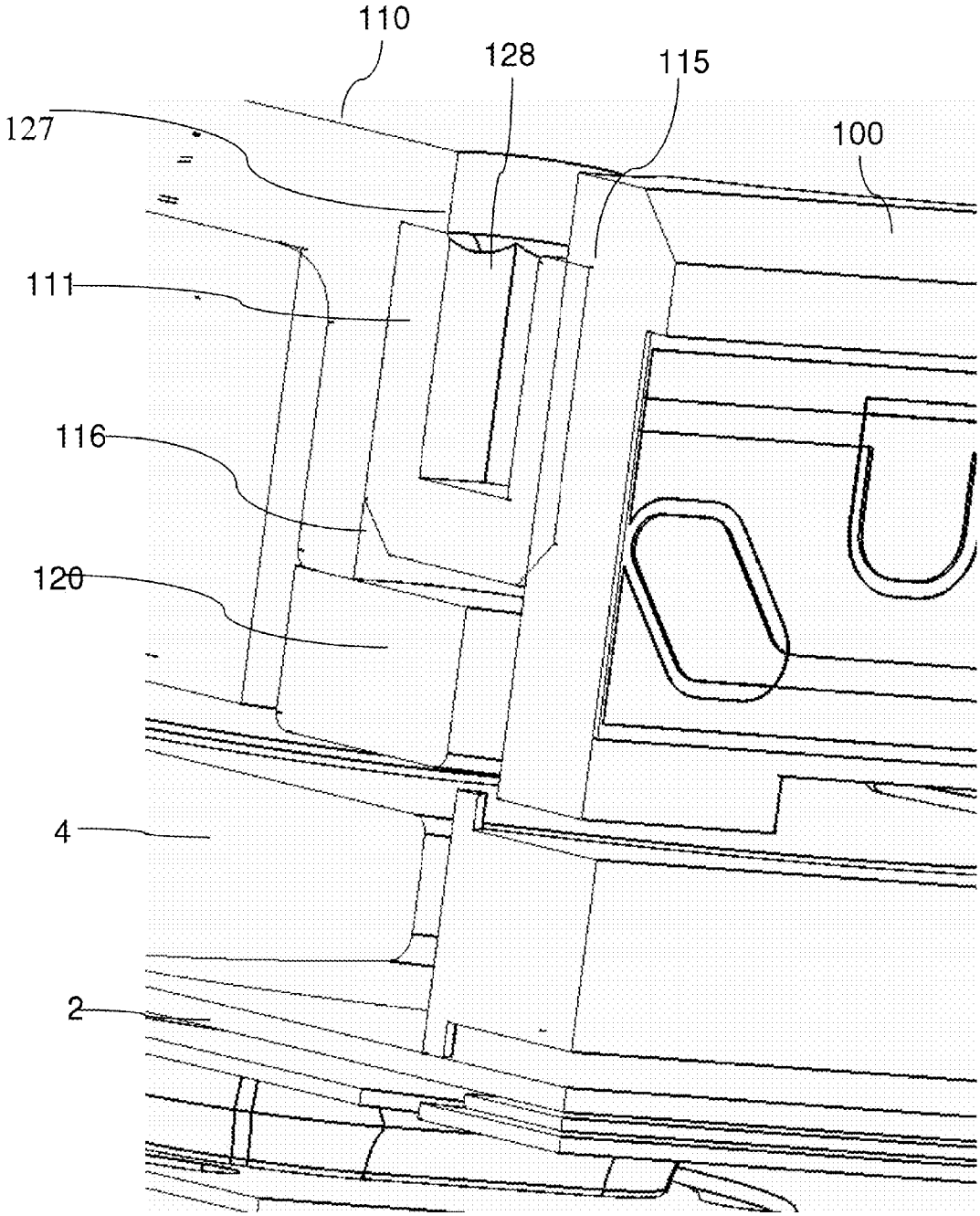

In FIGS. 7 and 7*a* a slightly different arrangement of the screw and bore is disclosed. Here, the threaded part 115 of the bore is in the frame 100 and the un-threaded part 116 is in the armature 110. Even if not clearly displayed in the drawings 7 and 7*a* the threads in the threaded part of the bore 115 are provided all through this bore part. When the screw 111 in this embodiment is turned to move upwards, it will eventually abut a flange 127 in the armature 110, and further turning of the screw in this direction will lift the armature 110 and widen the airgap. The screw has a recess 128 internally in order that a tool may be used to perform the turning thereof.

The magnetic armature 110 comprises a magnetic ring 120 joined therewith, and centrally in the magnetic armature an electric coil 140 is provided and by serving an electric audio signal at the coil 140 the magnetic attraction between the magnetic armature and the armature plate may be biased, in correspondence to the audio signal, which in turn will cause the air gap 130 to change its width in correspondence with the audio signal, and balancing the masses attached to each its side of the spring 2, a vibrational signal with a frequency content corresponding to the audio signal may be served through the coupling 3 and fed into a skull bone of a hearing impaired person wearing the device.

A soft spring 8 is provided and attached at the coupling 3, allowing a housing to be suspended from the vibrator 1. The housing may comprise a battery, and other electronic parts adapted for capturing sound and processing the resulting electric signal in order to provide an electric signal to be served at the coil 140.

Figure 3:
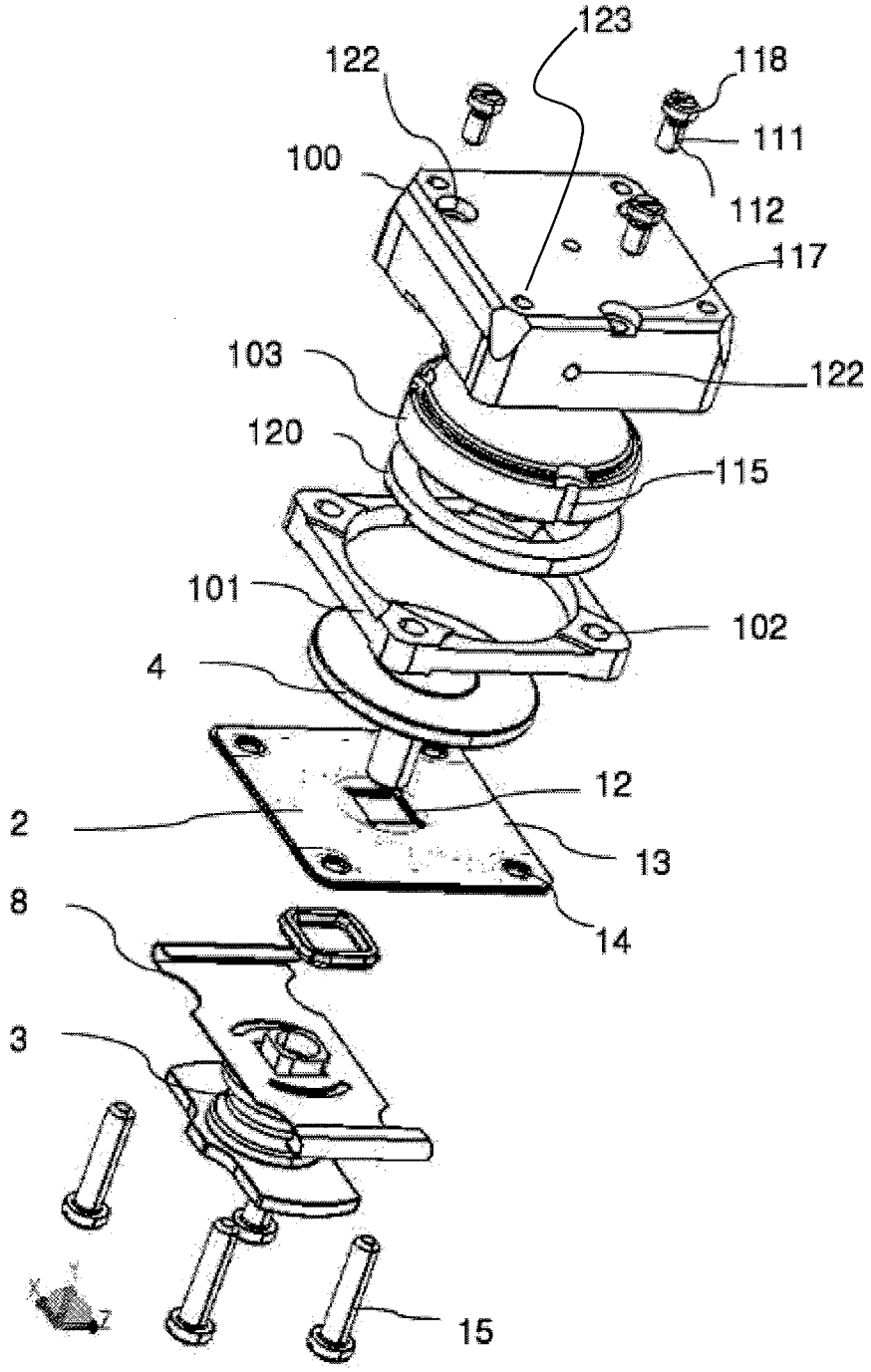
FIG. 3 is an exploded view of a further embodiment of the invention.
Figure 4:
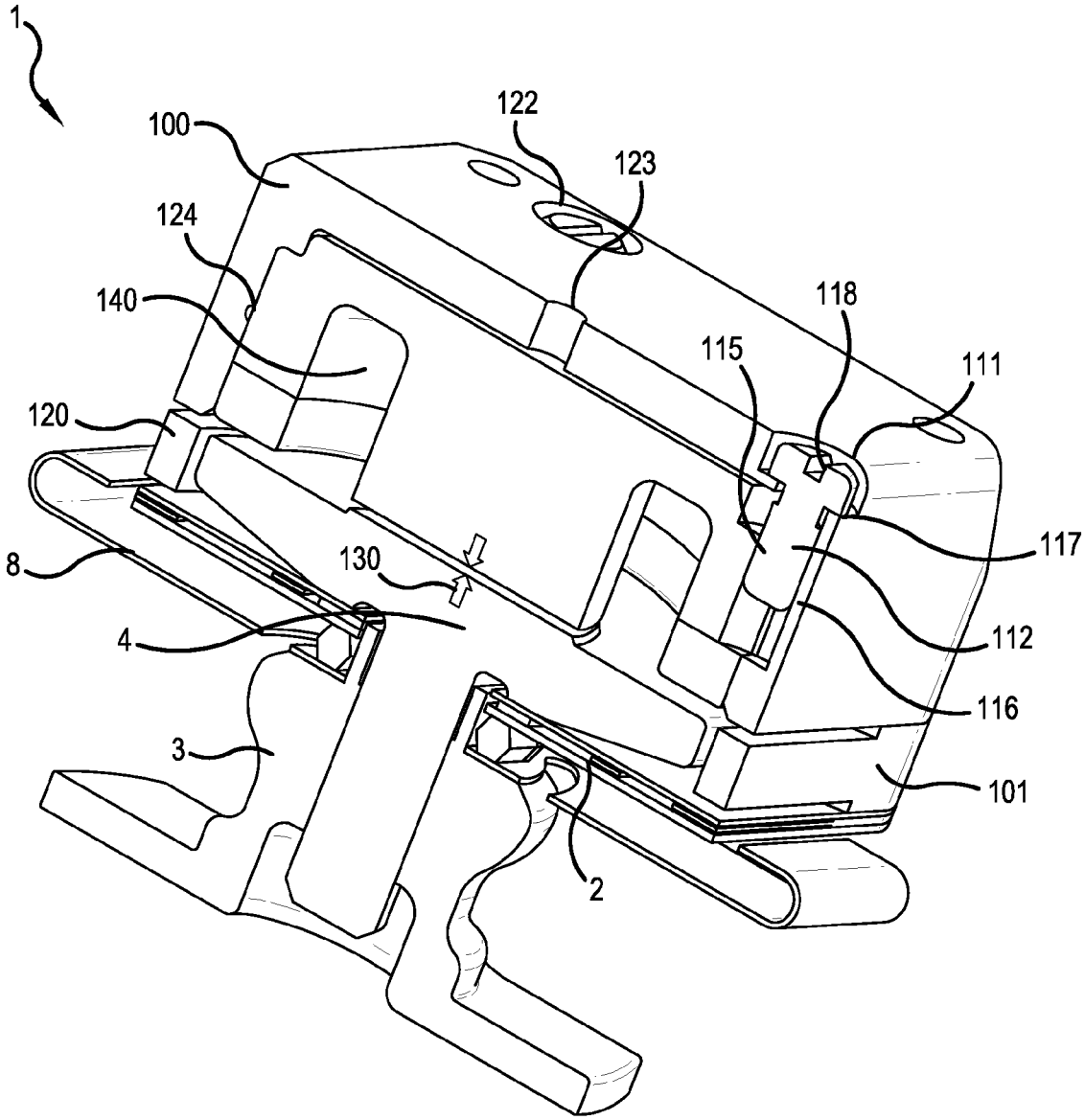
FIGS. 4 and 4*a* shows this embodiment in a sectional view in 3D projection.
Figure 4A:
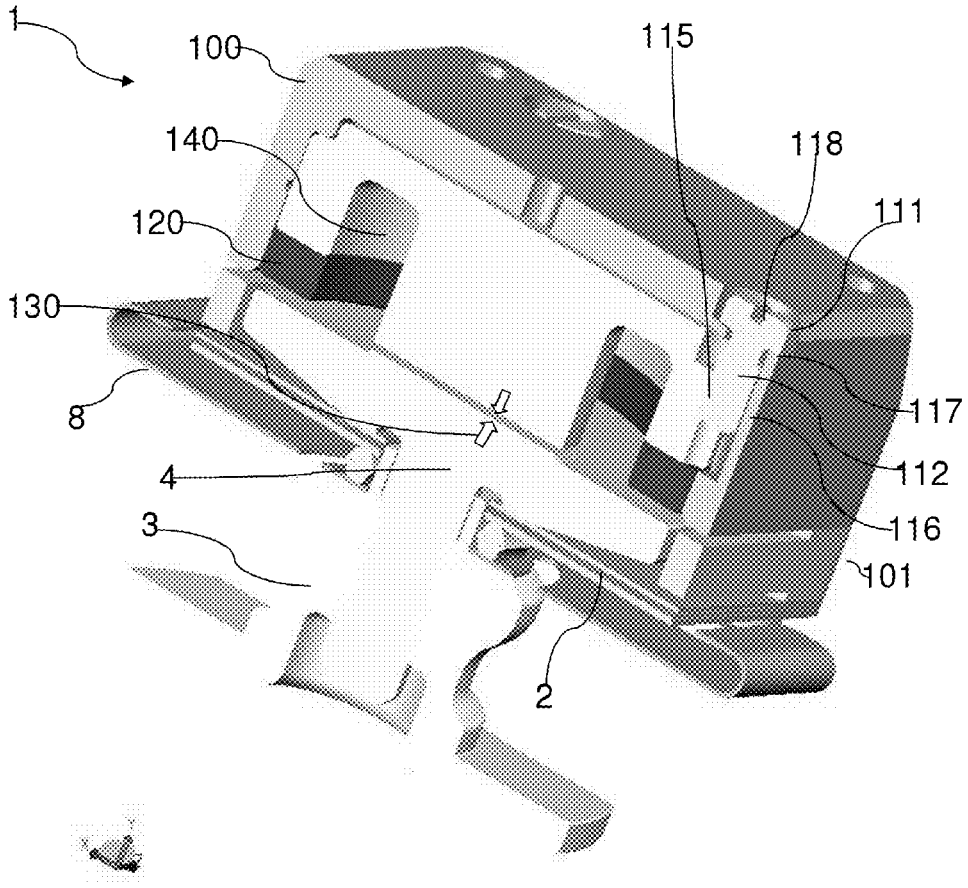

In FIGS. 3, 4 and 4*a* a further embodiment of the invention is presented. Here the frame 100 comprises a domed structure, with holes 122 provided therein for insertion of the screws 111. The domed structure lends more mass to the frame. This is important as the frame also provides a counter weight property to the vibrator, which serves to maximise the force amplitude of the vibrations served at the coupling 3.

In both embodiments it is intended to cement the frame 100 and the magnetic armature 103 to each other after adjustment of the air gap 130, but when using the domed frame 100 shown in FIGS. 3, 4 and 4*a* it is not easy to apply the cement, and to solve this problem, a number of cementing holes 123 are provided in the domed frame 100. Also to improve the distribution of the glue or cement a distribution channel 124 is provided inside the dome. This channel runs all the way round the inside surface of the dome, and will ensure a secure and even distribution of glue, when applied through the holes 123. In FIGS. 3, 4 and 4*a*, the coil is not disclosed, and in FIGS. 4 and 4*a* the reference number 140 refers to the space inside the armature where the coil is to be inserted.

Figure 5:
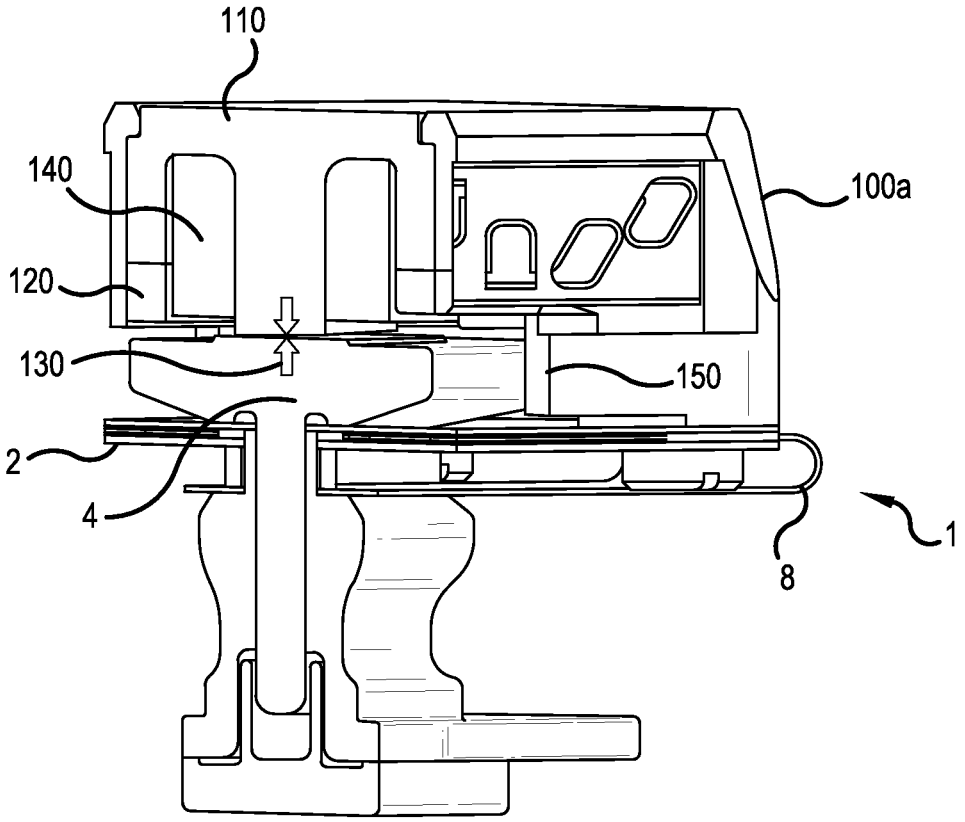
FIGS. 5 and 5*a* shows a section in a 3D projection of a further embodiment of the invention.
Figure 5A:
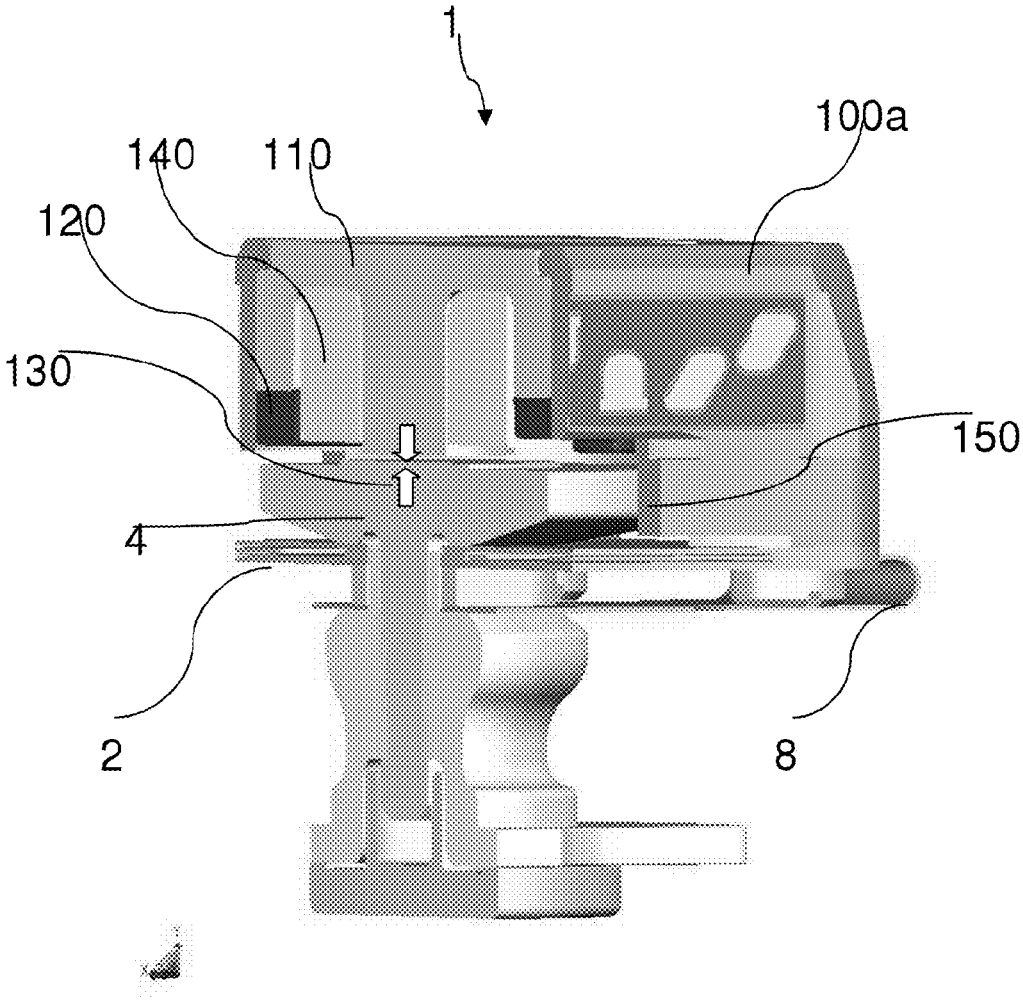

In FIGS. 5 and 5*a* a further embodiment of the invention is shown, wherein the frame 100 and distance element 101 are made to constitute a single frame piece 100*a*. This makes the vibrator a little simpler to produce, however pairs of windows 150 must be provided in the framepiece 100*a* in order that an optical instrument may be used in measuring the size of the air gap during adjustment of the size thereof as disclosed above. The windows 150 are provided in opposite positions on all 4 sides of the framepiece 100*a*.

Figure 6:
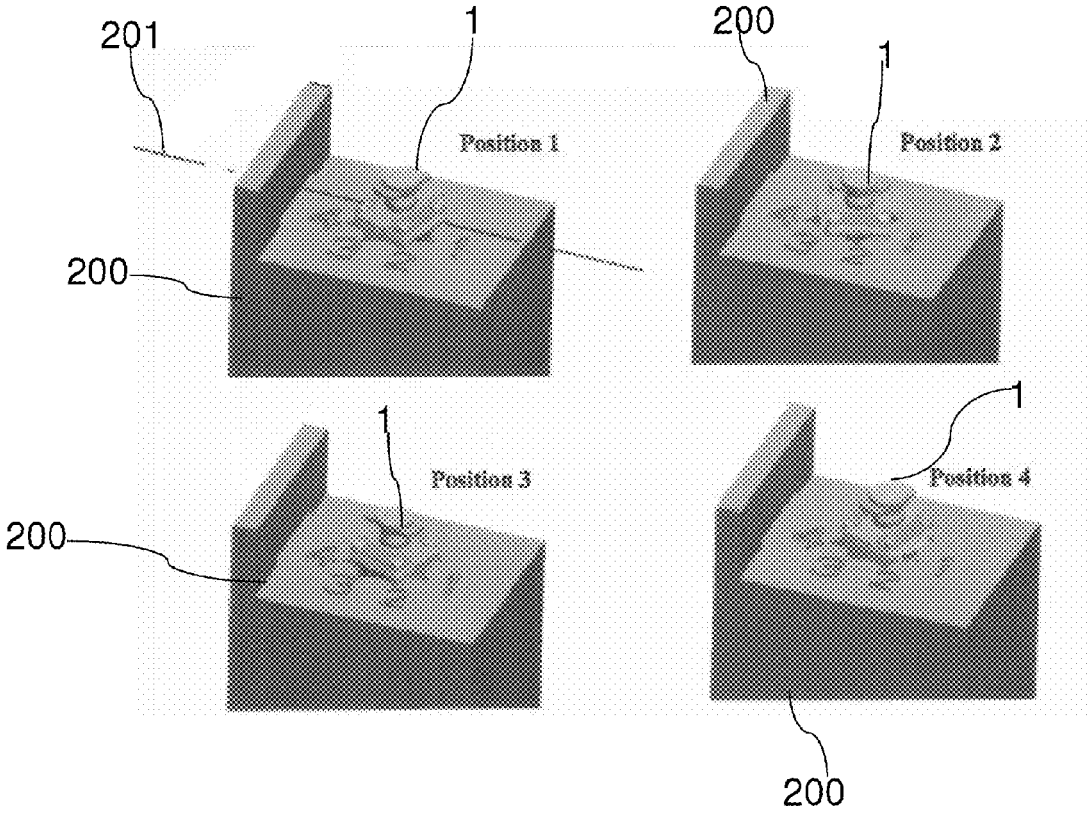
FIG. 6 shows 4 representations of a measuring stand with a vibrator mounted thereon in different measuring orientations.

In FIG. 6 a measuring stand 200 is schematically shown 4 times, with a vibrator 1 positioned thereon in 4 different measuring orientations, labeled 1,2,3,4 on top of the measuring stand 200. The size of the air gap may be measured with the vibrator oriented according to each of the positions during final assembly of the vibrator. Line 201 indicates the beam direction of a light beam, such as a laser beam, used to determine the size of the air gap. The beam will radiate into one of the 4 windows and a size measure of the air gap is registered, and this is repeated by sitting the vibrator in the 4 positions indicated and taking the measure in each position. The 4 obtained air gap measures are to fall within a predetermined interval in order for the vibrator to be declared usable. The 3 adjustment screws 111 (not seen in FIG. 6, where the device is placed head down) are possibly turned between measurements in order to obtain this.

Figure 2A:
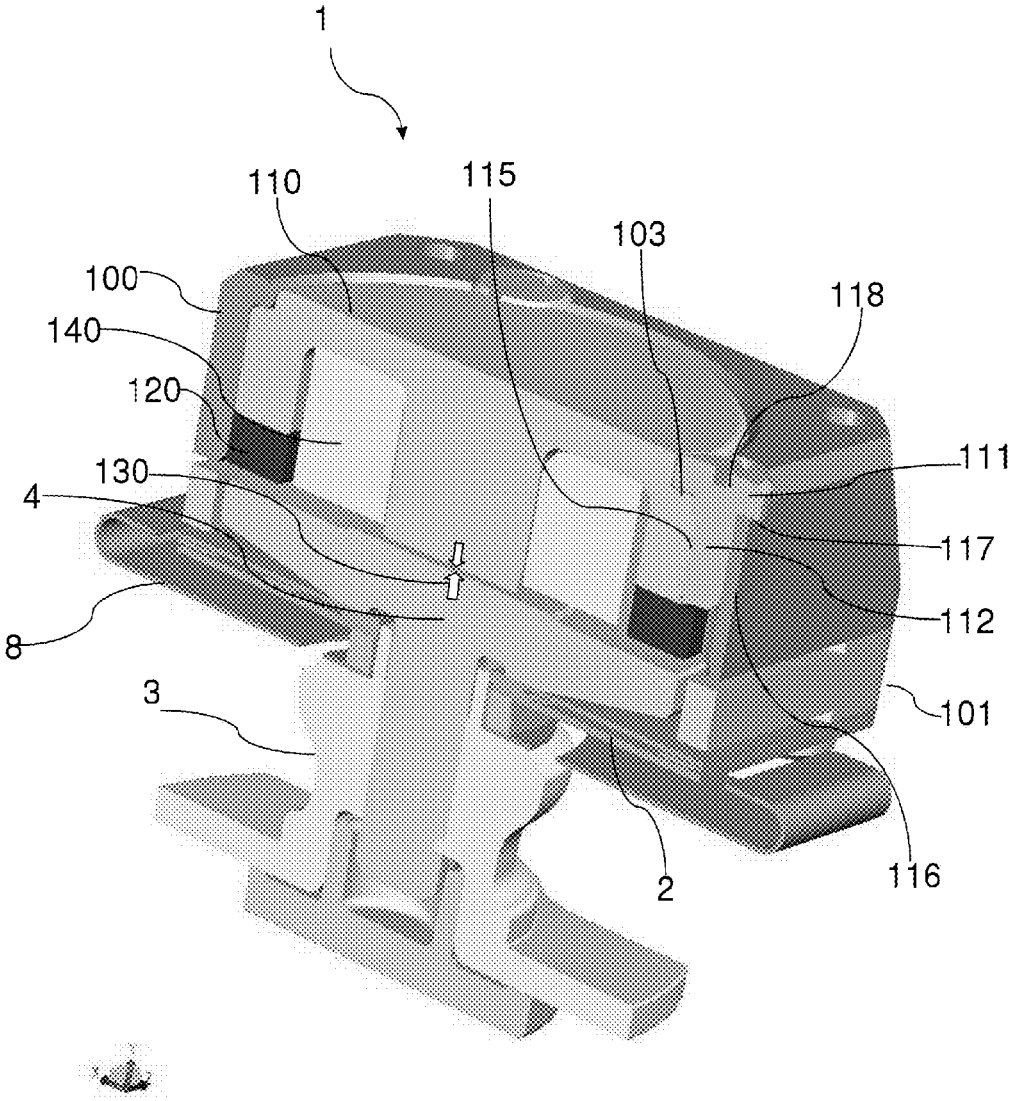

In the FIGS. 3, 4, 4*a*, 5 and 5*a* all parts corresponding to similar or identical parts in FIGS. 1, 2 and 2*a* are labelled with the same reference numbers.

The invention claimed is:

1. Vibrator, comprising:

a spring having a first end and a second end, a frame immovably attached to the second end, the frame carrying a movable armature and at the first end of the spring a coupling with an armature plate is immovably attached, whereby the armature plate and the movable armature are provided in close proximity with an air gap there between, a permanent magnet associated with one or both of the armature plate and/or the movable armature, an electrical coil associated with one or both of the armature plate and/or the movable armature, an adjustment screw provided to displace the movable armature towards or away from the armature plate, wherein the screw is inserted in a bore, wherein the bore has a length axis placed along a plane of intersection between the movable armature and the frame wherein one part of the bore is provided in the movable armature and an opposed part of the bore is provided in the frame, and one part of the bore is threaded and the opposed part is unthreaded.

2. Vibrator as claimed in claim 1, wherein the threaded part of the bore is provided in the movable armature, and an arrest surface is provided in the frame adjacent the bore and adapted to interact with a part of the screw and arresting motion of the screw in at least one axial direction.

3. Vibrator as claimed in claim 1, wherein the threaded part of the bore is provided in the frame, and an arrest surface is provided in the armature adjacent the bore and adapted to interact with a part of the screw and arresting the motion of the screw with respect to the armature in at least one axial direction.

4. Vibrator as claimed in claim 1, wherein the screw at a first end thereof comprises a tool engaging portion for turning the screw.

5. Vibrator as claimed in claim 3, wherein a radially extending flange is provided at the tool engaging portion adapted to abut the arrest surface at the frame.

6. Vibrator as claimed in claim 3, wherein a radially extending surface is provided at a screw part disposed at the opposite end relative to the tool engaging portion and adapted to abut an arrest surface of the frame.

7. Vibrator as claimed in any of the above claims, wherein three or more screws are provided and spaced evenly around the circumference of the electrical coil.

8. A method for adjusting an air gap of a vibrator that includes a planar spring having a first end and a second end, an armature plate immovably attached to the first end of the spring and a frame immovably attached to the second end of the spring, the frame carrying a movable armature and including at least one adjustment screw between the frame and the movable armature, the at least one adjustment screw having threads engaging a threaded bore of the movable armature, the method comprising:

measuring a size of the air gap between the armature plate and the movable armature with an optical instrument; and turning the at least one adjustment screw to obtain a predetermined air gap size.

9. The method as claimed in claim 8, further comprising:

fastening the frame and movable armature to one another when the air gap size is adjusted to a predetermined measure.

10. The method according to claim 9, wherein the fastening includes applying an adhesive material in a gap between the frame and the movable armature.

11. The method according to claim 9, wherein the fastening includes applying an adhesive material into cementing holes in the frame.

* * * * *